United States Patent [19]

Hook

[11] 4,037,865

[45] July 26, 1977

[54] DOOR FURNITURE MOUNTING

[75] Inventor: John Laurence Hook, Doncaster, Australia

[73] Assignee: Gainsborough Hardware Industries, Pty., Ltd., Australia

[21] Appl. No.: 713,720

[22] Filed: Aug. 12, 1976

[30] Foreign Application Priority Data

Aug. 14, 1975 Australia ..... 2798/75

[51] Int. Cl.[2] ..... E05C 1/06

[52] U.S. Cl. ..... 292/357

[58] Field of Search ..... 70/451, 452, 370; 248/27; 292/356, 357, 169, 348; 85/50

[56] References Cited

U.S. PATENT DOCUMENTS

| | | | |
|---|---|---|---|
| 1,304,105 | 5/1919 | Segal | 85/50 R |
| 3,228,218 | 1/1966 | Wilson | 292/356 X |
| 3,677,593 | 7/1972 | Wahlberg | 292/356 |
| 3,985,008 | 10/1976 | Hart | 292/357 |

*Primary Examiner*—Richard E. Moore

[57] ABSTRACT

Device for mounting door handles on a door. A pair of flat annular discs disposed one to each side of the door have central screw fittings to attach to escutcheon plates which carry the door handles. Discs are interconnected by screw clamps which extend through one or more holes in door and draw the discs together against the door. Each disc has three circumferentially spaced tongues which extend generally circumferentially of the disc but project inwardly toward the door. Tongues are spaced radially inwardly from perimeter of the disc. Tongues can serve to locate discs concentrically of an appropriately sized circular hole through the door by engaging the wall of the hole but in the event that tongues cannot enter a hole in the door but engage side faces of the door they can be deformed by engagement with the door under action of clamp means to allow discs to come flat against door faces.

12 Claims, 11 Drawing Figures

DOOR FURNITURE MOUNTING

BACKGROUND OF THE INVENTION

1. Field of the Invention

This invention is concerned with the installation of door furniture, particularly door handle and latch assemblies.

2. Description of Prior Art

A door handle assembly generally comprises a pair of handles disposed one to each side of the door and mounted on a shaft which extends through a transverse hole in the door and through a latch installed in the door so that its bolt can extend from the outer edge of the door but can be retracted by rotation of the handle shaft. A pair of escutcheon plates are mounted against the side faces of the door to cover the hole through which the handle shaft passes. In some cases the escutcheon plates are simply attached to the door by means of screws which remain visible but in other constructions a concealed mounting is achieved. One example of a concealed mounting is disclosed in Australian Patent No. 409,156 in which each escutcheon plate is screw fitted to a mounting plate which is fixed to the door and covered by the escutcheon plate.

One problem in fitting door handle assemblies, particularly in the case where concealed mountings are employed, is ensuring that the escutcheon plates are properly aligned relative to the latch so that the handle shaft and the handles will be properly centred relative to the escutcheon plates and will not bind thereon. In order to meet this problem there have been developed latches formed with openings to receive posts extending between the escutcheon plates, or between a pair of escutcheon plate mounting discs, so that when the posts are engaged with these openings the escutcheon plates are properly centred on the latch opening which receives the handle shaft. In order to make use of a latch in this way it is necessary to drill three holes in the door, one for the handle shaft and two for the posts which are to engage the alignment openings in the latch, or to provide a single relatively large diameter opening which will receive both the shaft and the posts. The provision of a single opening is more common and, in fact, there is a growing tendency for doors to be supplied pre-drilled with large diameter holes. These holes are commonly $2\frac{1}{8}$ inches in diameter. However, not all doors are pre-drilled nor are all latches provided with alignment openings and there is therefore a need for a universal mounting means which can suit all combinations of door and latch. The present invention enables such a universal mounting means to be achieved.

SUMMARY OF THE INVENTION

According to the present invention there is provided a door furniture mounting device comprising a pair of flat, annular mounting discs and clamp means to draw the discs toward one another in parallel aligned array, wherein each disc is formed with a plurality of circumferentially spaced tongues spaced radially inwardly from the perimeter of the disc and extending generally circumferentially of the disc to free ends displaced laterally of the disc. In use of such a mounting device, the free ends of the tongues are displaced laterally inwardly of said pair of mounting discs when the discs are held in said aligned array and can serve to locate the discs concentrically of an appropriately sized circular hole through the door by engaging the wall of the hole. On the other hand, in the event that the tongues cannot enter a hole in the door but engage the side faces of the door, they can be deformed by their engagement with the door under the action of the clamp means to allow the discs to come flat against the door faces.

Preferably, the tongues are formed integrally with the discs with their free ends pressed out of the general plane of the discs.

Preferably further, there is circumferential clearance between the free end of each tongue and the adjacent part of the disc to permit the free end to be moved back without binding on said part to a position in which it does not project to said one side of the disc.

Preferably too, each mounting disc has means to enable an escutcheon plate to be fitted to it. For example it may have a central spigot or flange provided with a screw thread to co-operate with a mating screw thread on an escutcheon plate.

The clamp means may comprise a pair of posts to extend between the mounting discs and a pair of clamping screws to pass through holes in one of the discs and into internally screw threaded bores in the ends of the posts. The posts may be formed integrally with the other of the mounting discs or they may be formed as separate tubular elements to be fixed to said other mounting disc by further clamping screws.

The invention also extends to a door handle assembly having a pair of escutcheon plates mounted on a door by means of the above defined mounting.

BRIEF DESCRIPTION OF THE DRAWINGS

In order that the invention may be more fully explained one particular embodiment and various modes of its use will now be described with reference to the accompanying drawings, in which.

DESCRIPTION OF THE PREFERRED EMBODIMENT

Figure 1:
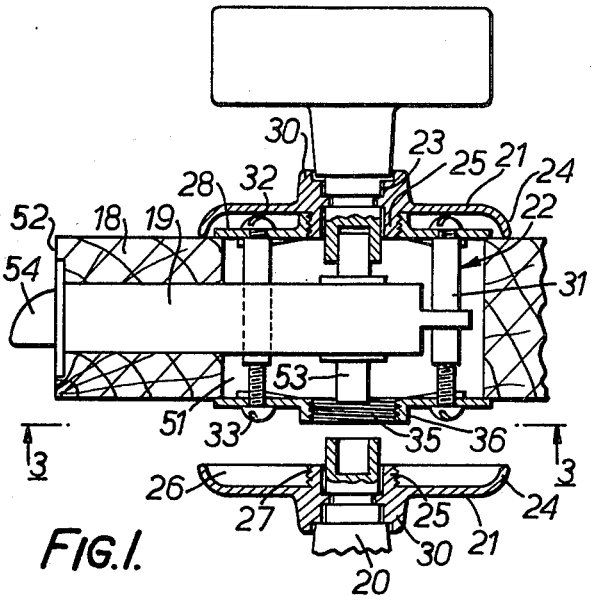
FIG. 1 is a horizontal cross-section through part of a door fitted with a latch and door handle assembly with the aid of a mounting device constructed in accordance with the invention.

FIG. 1 shows part of a door 18 fitted with a latch 19, handles 20 and escutcheon plates 21 with the aid of a mounting device which is constructed in accordance with the invention and is denoted generally as 22.

Escutcheon plates 21 are of conventional construction and their outer faces may have a decorative finish. They have central openings 23 in which the handles are held captive and these openings are surrounded by inwardly projecting central bosses 25 and outwardly projecting bosses 30. The escutcheon plates also have inturned peripheral rims 24 so that annular channels 26 are definial between rims 24 and bosses 25. The latter bosses are externally screw threaded at 27.

Mounting 22 is consitituted by a pair of mounting discs 28, a pair of tubular posts 31, a pair of short screws 32 and a pair of longer screws 33.

Discs 28 are of identical construction but the orientation of one is reversed compared with the other. Each disc 28 has a circular outer perimeter 34 and a circular central opening 35. Opening 35 is surrounded by an outwardly projecting cylindrical flange 36 which is externally screw threaded at 37 so that it can be screwed onto the externally screw threaded boss 25 of the respective escutcheon plate 21 allowing the disc to be neatly fitted within the annular channel 26 of the escutcheon plate.

Each disc 28 is formed with three circumferentially spaced tongues 38 which are spaced radially inwardly from the outer perimeter 34 of the disc and which extend generally circumferentially of the disc to free ends 39 which are displaced laterally inwardly of the disc so as that end portions of the tongues project laterally inwardly from the disc. Tongues 38 are formed integrally with the main part of the disc 28 and can readily be formed in a stamping and pressing operation. They extend circumferentially of the disc across notches 41 formed in the perimeter of the disc with particularly tongues 38 are formed by stamping out metal from a flat disc blank in the regions 42, 43, 44 to leave a strip of metal which remains connected at one end to the main part of the disc and pressing the strip to displace its free end laterally of the disc. Since metal is removed from the blank in the regions 44 there are circumferential gaps between the free ends of the tongues and the adjacent parts of the disc.

Each disc 28 is further provided with a pair of diametrically spaced holes 46. The holes 46 of the two discs receive the two pairs of screws 32, 33 which are extended through those holes and into internal screw threads in tubular posts 31 whereby to hold the discs in parallel aligned array. Three larger diameter holes 47 are formed in each disc 28 adjacent holes 46. The purpose of these holes will be explained below.

Figure 2:
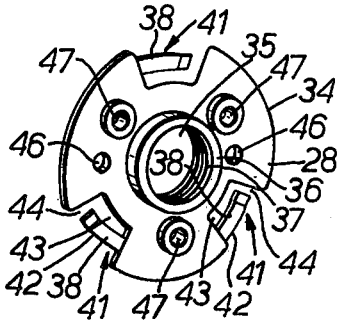
FIG. 2 is a perspective view of a mounting disc of the mounting device shown in FIG. 1.
Figure 3:
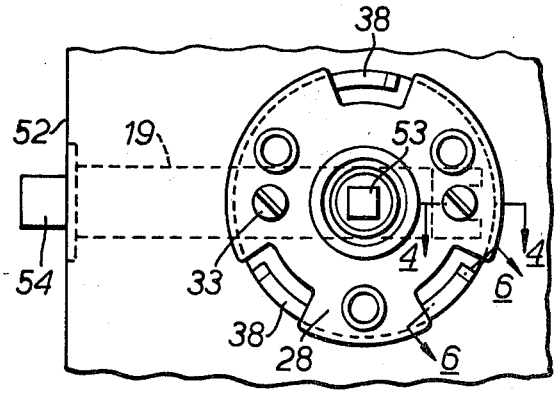
FIG. 3 is a cross-section on the line 3—3 in FIG. 1.
Figure 6:
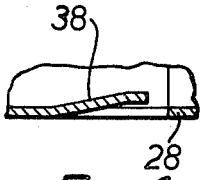
FIG. 6 is a cross-section on the line 6—6 in FIG. 3.

In the door furniture installation shown in FIGS. 1 to 3, a large diameter hole 51, say of $2\frac{1}{8}$ inches diameter, is drilled laterally through the door adjacent the outer edge 52 of the door in order to mount the handle assembly. Latch 19 is of the tubular type and it extends into opening 51 through a relatively small diameter hole drilled into the door from the door edge 52. The inner end of the latch has a transverse opening to receive the operating shaft 53. Latch bolt 54 normally projects from the outer edge 52 of the door but can be retracted by rotation of shaft 53.

The handles 20 and escutcheon plates 21 are mounted one to each side of the door by means of the mounting device 22. Latch 19 is provided with a pair of alignment openings and the posts 31 of the mounting device are extended through these openings to provide self alignment of the mounting device and therefore the escutcheon plates. To install the mounting device one mounting disc 28 is removed and posts 31 are pushed through the alignment openings of the latch. The disc is then reconnected to the posts 31 by the respective screws and these screws are tightened to clamp the two discs together one to either side of the door. The outer margins of the discs project slightly beyond the perimeter of hole 51 and so engage outer faces of the door whereas the laterally inwardly displaced free ends of tongues 38 enter hole 51. Because of the engagement between posts 31 and the alignment holes in latch 19, discs 28 are properly centred on the shaft 53. The escutcheon plates which screw onto these plates will therefore also be properly centred and the door handles can be fitted to shaft 43 to rotate in the central openings of the escutcheon plates without binding.

Figure 4:
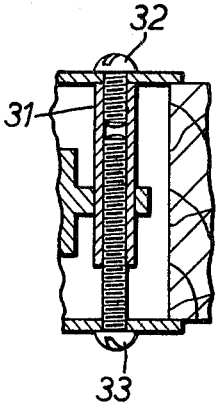
FIG. 4 is a cross-section on the line 4—4 in FIG. 3.
Figure 5:
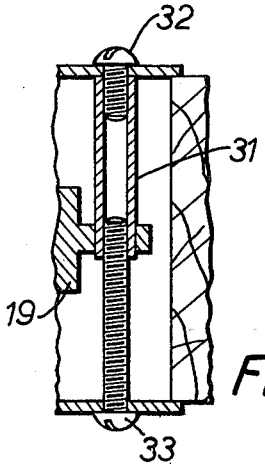
FIG. 5 is a cross-section corresponding to that of FIG. 4 but showing how the mounting device can be fitted to a thicker door.

FIGS. 4 and 5 show the range of adjustment which can be achieved with clamping screws 32, 33 to accommodate doors of differing thicknesses. FIG. 4 shows the mounting device fitted to a relatively thin door and FIG. 5 shows the device fitted to a thicker door and it will be seen that because screws 33 are much longer than screws 32 a wide range of adjustment can be achieved by operating only on the longer screws from one side of the door.

As previously mentioned not all doors are predrilled with large diameter holes of the type indicated as 51 in FIGS. 1 and 3, nor are all latches provided with alignment holes. FIGS. 7 to 11 illustrate the various combinations of door and latch which can arise in practice and the manner in which the mounting device 22 can be used to install the door furniture in these various cases.

Figure 7:
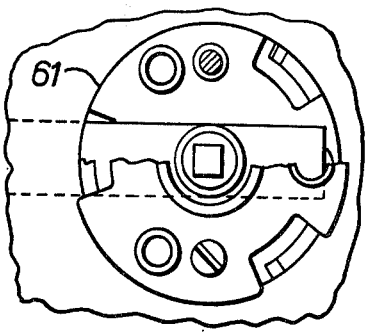
FIGS. 7 to 9 illustrate various alternative handle and latch installations which can be achieved with the aid of the illustrated mounting device.

FIG. 7 illustrates a mounting in which the door is provided with a large diameter mounting opening 61 but the latch is not provided with alignment openings. In this case mounting device 22 is installed with its posts 31 spaced vertically rather than horizontally so as to extend through hole 61 without engaging the latch. In this case alignment of mounting discs 28 and consequently the escutcheon plates and handles is provided by the engagement of the laterally inwardly displaced free ends 39 of the disc tongues 38 with the perimeter wall of hole 61. Tongues 38 are accurately set in cylindrical array about the centre of the disc and provided hole 61 is drilled accurately both as to position and size, the self centering action of tongues 38 within hole 61 will be quite sufficient to ensure accurate alignment of the escutcheon plates and handles relative to the latch.

Figure 8:
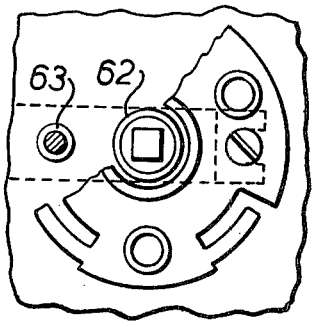

FIG. 8 illustrates a mounting in which the latch is provided with alignment openings but the door is not provided with a large diameter mounting hole. In this case it is necessary to drill three holes in the door — a central hole 62 for the shaft and a pair of smaller holes 63 to receive posts 31 which can then extend through the alignment holes in the latch to provide self alignment of the mounting discs.

Figure 9:
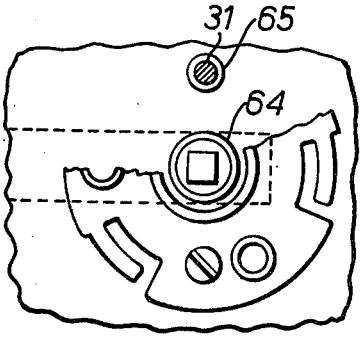

FIG. 9 illustrates a mounting in which the latch is not provided with alignment holes nor is the door provided with a large diameter mounting opening. In this case it is necessary to drill a hole 64 for the shaft and two smaller diameter vertically spaced holes 65 above and below hole 64 to receive posts 31 of the mounting device. In this case the posts extend through the door without engaging the latch and no self aligning action is provided.

In the case illustrated by FIGS. 8 and 9, major parts of mounting discs 28 lie flat against the side faces of the door in the finished installation. In particular those parts of the discs wich incorporate tongues 38 are drawn against the faces of the door. Since the free ends of the tongues are displaced laterally inwardly they initially foul the door when the mounting discs 28 are clamped together. However the tongues are formed so that they deform quite readily under the clamping pressure applied by screws 32, 33 so that they bend back to permit the mounting discs to lie flat against the door faces. If the tongues could not deform in this manner a satisfactory mounting could not be achieved in the cases illustrated by FIGS. 8 and 9.

In order to ensure that tongues 38 can bend back properly to allow the mounting discs to come flat against the door faces, it is important to provide circumferential clearances adjacent their free ends. If such clearance were not provided the free ends of the tongues could bind against the adjacent parts of the discs before retracting sufficiently to permit the discs to lie flat against the door faces.

Figure 11:
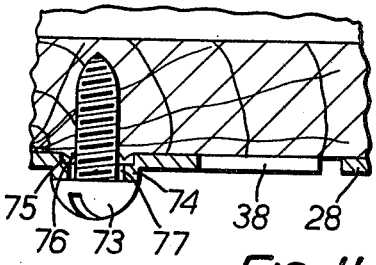
FIG. 11 is a cross-section generally on the line 11—11 in FIG. 10.
Figure 10:
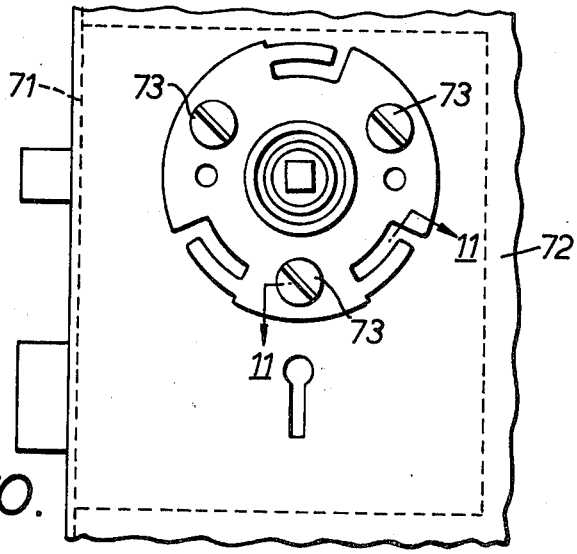
FIG. 10 shows the installation of a mortice lock using the mounting device of the present invention.

The three relatively large diameter holes 47 in discs 28 enable a mortice lock in the manner shown in FIGS. 10 and 11. These show a mortice lock 71 installed in a door 72. The mortice lock is much larger than the tubular latches of the previously illustrated installations and it is not possible to pass the posts 31 through the door because the body of lock causes an obstruction. In this case the discs 28 are simply fastened to the faces of the door by three wood screws extended through the large diameter holes 47. In stamping out holes 47, raised rims 74 are formed so that rim sockets 75 are defined at the back faces of the discs to permit puckering of the door timber around the screws as indicated at 76 in FIG. 11. As also shown in that Figure, there is a small clearance 77 between each screw 73 and the respective hole 47 so that it is possible to move the discs slightly for fine adjustment of the escutcheon plates when the handle assembly is being fitted.

From the above description it will be appreciated that the illustrated mounting device has universal application in that it can be used with most combinations of latch and door which arise in practice. Thus, posts 31 can be used to provide self alignment in the event that the latch has appropriate alignment openings regardless of whether the door is provided with a large diameter mounting opening or not; the tongues 38 provide a self alignment characteristic in the event that the door does have a large diameter mounting opening but the latch does not have alignment holes; the device can also be used when the latch does not have alignment holes and the door does not have a large diameter mounting opening; and the discs 28 can be used to mount the escutcheon plates in a mortice lock installation. Moreover the components of this device can be produced quite cheaply since discs 28 are identical and can be produced from flat sheet blanks and the support posts 31 can be formed from standard metal tube. Only three types of component are required to assemble the device i.e., the mounting discs, the tube posts and the screws, and stock control is therefore very simple. The fact that posts 31 are formed separately makes for easier packaging and also enables a range of post sizes to be provided at little extra manufacturing cost. However, the illustrated construction has been advanced by way of example only and it could by varied considerably, for example although each of the illustrated mounting discs has three tongues 38 this is merely a matter of preference and it would be possible to alter that number. The shape of the tongues themselves could of course be varied. The tongues could for example be linked between their ends to provide the necessary laterally inwardly projecting portions. It is accordingly to be understood that the invention is in no way limited to the details of the illustrated device and that many variations may be made without departing from the scope of the appended claims.

We claim:

1. A door furniture mounting device comprising a pair of flat annular mounting discs and clamp means to draw the discs toward one another in parallel aligned array, wherein each disc is formed with a plurality of circumferentially spaced tongues which extend generally circumferentially of the disc but project to one side of the disc and which are spaced radially inwardly from the perimeter of the disc whereby in use of the mounting device the tongues may project laterally inwardly of said pair of mounting discs when the discs are held in said aligned array and can serve to locate the discs concentrically of an appropriately sized circular hole through the door by engaging the wall of the hole whereas in the event that the tongues cannot enter a hole in the door but engage the side faces of the door they can be deformed by their engagement with the door under the action of the clamp means to allow the discs to come flat against the door faces.

2. A door furniture mounting device as claimed in claim 1, wherein the tongues of each disc are formed integrally with that disc and have free ends pressed out of the general plane of the disc.

3. A door furniture mounting device as claimed in claim 2, wherein there is a circumferential gap between the free end of each tongue and the adjacent part of the respective disc to permit the free end to be moved back without binding on said part to a position in which it does not project laterally of the disc.

4. A door furniture mounting device as claimed in claim 1, wherein each mounting disc has attachment means for attachment of an escutcheon plate to it.

5. A door furniture mounting device as claimed in claim 4, wherein said attachment means comprises a peripheral flange formed at the inner periphery of the disc to project laterally of the disc and provided with a screw thread about a screw axis extending perpendicularly and centrally of the disc.

6. A door furniture mounting device as claimed in claim 5, wherein the clamp means comprises a pair of posts to extend between the mounting discs and fixed or fixable to one of the discs and clamping screws to extend through holes in the other of the discs to engage internally screw threaded bores in the posts.

7. A door furniture mounting device as claimed in claim 6, wherein the posts are formed as tubular elements which are fixable to said one disc by further clamping screws.

8. The combination of a door;

a latch mechanism mounted in the door between the two faces of the door and including a latch operator shaft perpendicular to the door;

a door furniture mounting device as claimed in claim 1 fitted to the door such that said discs are clamped by the clamping means one to each face of the door so as to be disposed concentrically about the axis of the said shaft;

a pair of escutcheon plates attached to and covering said discs and provided with openings aligned with said shaft; and a pair of handles extending through the openings — the escutcheon plates are coupled one to each end of the shaft.

9. The combination claimed in claim 8, wherein there is a circular hole through the door the peripheral wall of which is engaged by the tongues of the discs to position the discs relative to the door, the outer margins of the disc engaging the faces of the door about said circular hole.

10. The combination claimed in claim 9, wherein the clamp means of the mounting device comprises a pair of posts connecting the discs which posts extend through said hole in the door and engage the latch mechanism so as to position the latch mechanism relative to the discs.

11. The combination claimed in claim 8, wherein the tongues of said discs are engaged with the faces of the door and held flat against those faces by the action of the clamp means.

12. The combination claimed in claim 11, wherein the clamp means comprises a pair of posts connecting the discs and extended through individual holes in the door to engage the latch mechanism so as to position the latch mechanism relative to the discs.

* * * * *